United States Patent [19]

Wignall et al.

[11] 4,028,910

[45] June 14, 1977

[54] TUBULAR KNITTED FABRIC

[75] Inventors: Harry Wignall; William Ewart Alan Shelton; John Michael Klee, all of Leicester, England

[73] Assignee: The Bentley Engineering Company, Ltd., England

[22] Filed: Oct. 23, 1968

[21] Appl. No.: 769,840

[30] Foreign Application Priority Data

Oct. 27, 1967 United Kingdom ..... 48922/67

[52] U.S. Cl. ..... 66/26; 66/148; 66/187

[51] Int. Cl.[2] ..... D04B 9/10; D04B 9/40; D04B 9/06

[58] Field of Search ..... 66/148, 26, 14

*Primary Examiner*—Ronald Feldbaum

*Attorney, Agent, or Firm*—Robert E. Burns; Emmanuel J. Lobato; Bruce L. Adams

[57] ABSTRACT

A knitted fabric tube, and more particularly a portion of a garment to be worn on a foot, closed by being constrained into a constricted form without twisting of the fabric tube and retained in the closed state; and also a method and machine for producing such closed fabric tube particularly with the closure formed as part of the procedure in knitting the tube. The closure by constriction is conveniently effected by wrapping a binding thread around the fabric between parts to form plies of a double welt like portion of fabric at the position of the crease or fold of the welt like portion, portions of the binding thread extending each way from the wrapping turns being knitted into the fabric structure.

14 Claims, 12 Drawing Figures

Figure 1:
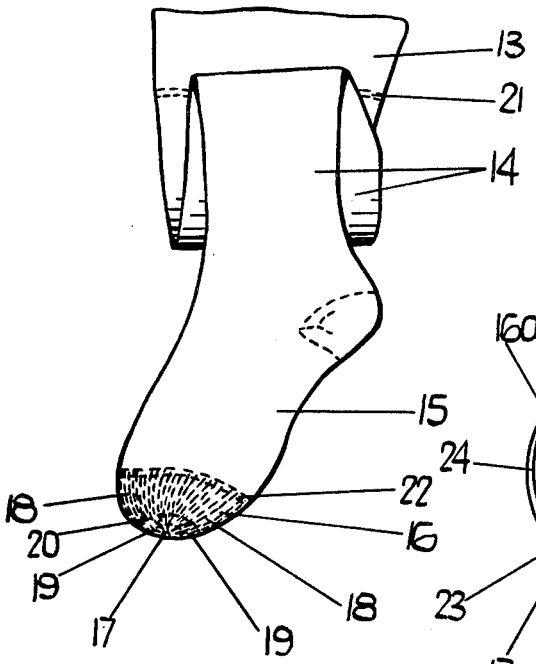

FIG.4.
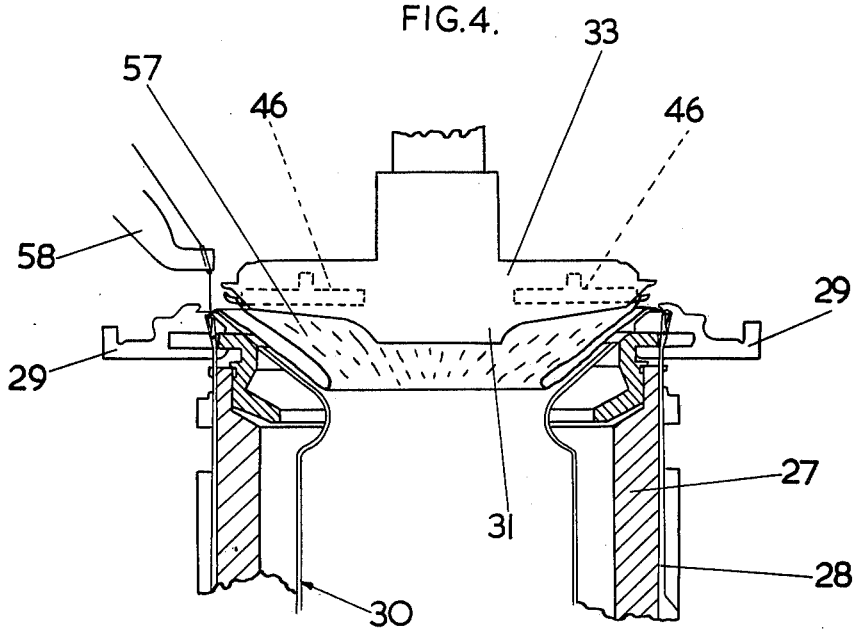
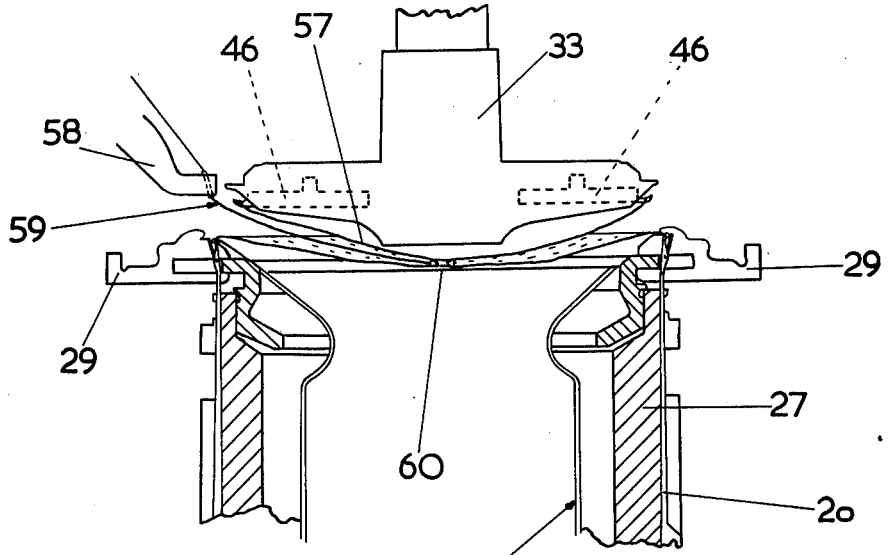
FIG. 5.

TUBULAR KNITTED FABRIC

This invention is for improvements relating to tubular knitted fabric and is concerned more particularly with the closure of a fabric tube in a manner which does not require linking or seaming operations to be performed after knitting of the tube. The invention has for an object to provide an improved closure means and procedure and apparatus for producing it whereby the improvement can be practised in a simple manner economically.

In accordance with one embodiment of the invention there is provided a knitted fabric tube closed by being constrained into a constricted form without twisting of the fabric tube and retained in the constricted form by a welded fixing at the constriction. In accordance with another embodiment of the invention there is provided a tubular knit hosiery article having a foot portion formed of single ply tubular knit fabric, a toe portion formed of double ply tubular knit fabric having first formed and last formed ends thereof continuously joined by knit stitches annularly at the juncture with said foot portion and being folded back on itself at a toe portion outer end of the article to form said double ply construction, and a length of yarn disposed between the plies of said toe portion and anchored to said toe portion with at least one constricting loop around said fold at said toe portion outer end of the article to close substantially said toe portion outer end.

In practising the invention the closed end part of the fabric tube may be formed of a yarn of material, for example, a man-made fibre, capable of being set by the aid of heat treatment into a particular form which it has been caused to assume, and so set to the closed form. Alternatively, the closed part of the fabric tube may be retained in restricted form by a thread binding it to that form, such binding thread being conveniently positioned in a fold between two layers of fabric turned in the manner of a welt. The binding thread is conveniently constituted by a length of yarn (for example a yarn used for knitting the tube) the ends of which are knitted into the fabric. An important application of the invention is to the closing of the toe end of a portion of a knitted clothing article intended to be worn on a foot. Examples of clothing articles having such portions are stockings, stocking tights, and socks.

The invention comprises a method of forming a knitted fabric tube closed at one end which comprises knitting a tubular seamless hosiery article on a circular knitting machine, which comprises knitting a tubular foot portion, knitting a first course at a toe portion, knitting further courses of said toe portion as tubular fabric depending from loop holding instruments of said machine engaging loops of said first course, looping a binding yarn under tension around the depending toe fabric to constrict said depending fabric to at least a substantially closed form and knitting together the first and a last formed course of the toe portion to anchor them to a course of said foot portion.

The method may comprise the step of knitting a portion of double thickness tubular fabric of welt-like structure and constricting the double thickness fabric to a substantially closed condition at the fold of the welt-like form. The portion of fabric which is constricted is conveniently formed of a yarn of material capable of being set by the aid of heat treatment and the method may comprise the step of setting the fabric in the closed constricted form.

The method of the invention in one form involves, whilst still holding tubular knitted fabric on the knitting elements, a procedure of providing closure means for the fabric tube, comprising the step of encircling the tube with a yarn in such manner that the periphery of the tube, at an end thereof, is drawn inwards by the constraining yarn thereby reducing the diameter of the tube until closure is obtained, and fixing the tube in closed condition.

The constriction of the fabric tube to close it may be effected in various ways. In some ways a binding yarn is used to constrict the fabric. In other cases the fabric is constricted by means which close in on the fabric tube to draw it closed and may serve to form a welded closure which is self retaining when the closing means is withdrawn.

In a convenient procedure employing a binding yarn (conveniently of thermoplastic material), this may be wound tightly around the tube in a two-ply hem-like formation in the fabric, such yarn being applied during the knitting procedure. The drawing of the binding yarn to effect closure occurs during the knitting procedure. The yarn may be incorporated between plies of a fabric structure which is formed in the same manner as a turned welt, the constricting yarn being caused to be wound around the fabric tube immediately before the turning of the welt-like structure occurs. i.e. immediately before the first formed courses of the welt fabric are applied to the needles to be joined to the last formed courses of the welt fabric.

In a convenient manner of practising the method, it comprises the step of knitting a portion of fabric of welt-like form and, immediately before closing the welt, constricting the fabric therein by a binding thread applied between the plies of the welt to bring it to closed form, the binding thread being bound around the fabric immediately before the welt-like fabric is closed. A presser means may be employed to press the welt material inwardly before the binding thread is applied.

In an alternative procedure the welt-like portion of fabric may be constricted by being pressed inwardly by presser members, heat being applied to the welt-like portion and/or to an embracing clip when the fabric is constricted.

The procedure as applied to forming in a knitted article of clothing a tubular part to be worn on a foot part comprises knitting a tubular toe end portion and closing said portion by a method as aforementioned The invention further provides, in or for a circular knitting machine, means whereby at a desired stage in the knitting of tubular fabric, the fabric can be caused to be constricted to close it substantially completely. Such means may operate to apply a binding yarn to engage the fabric for constriction thereof or may operate directly on the fabric to close it and weld it by heat in closed condition.

The means for causing constriction of the tubular fabric is conveniently organised so as to be operated immediately before completion of a turned welt-like portion of the fabric to constrict the fold or crease of the welt like portion to a substantially closed condition.

To assist in setting or welding the fabric there may be incorporated in the fabric or provided externally as a fixing means material having a lower melting point than the yarn from which the tubular fabric is formed so that when the closed part of the fabric is set by the aid of heat treatment the low melting point material will become at least partly melted and on solidifying will fix the closure of the fabric tube.

A number of ways in which the invention can be practised are illustrated diagrammatically in the accompanying drawings and will now be described by way of example only.

Figure 2:
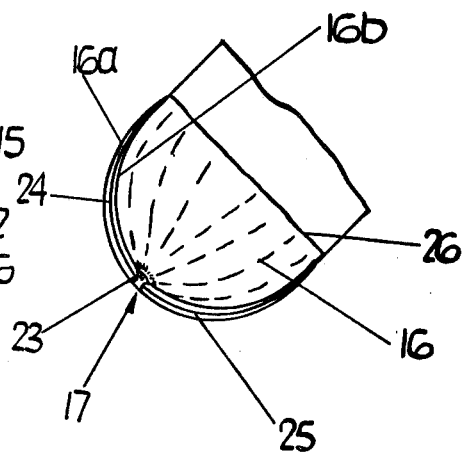
Figure 11:
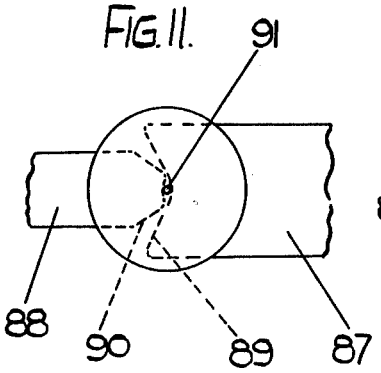
Figure 12:
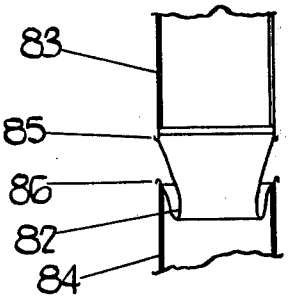
Figure 3:
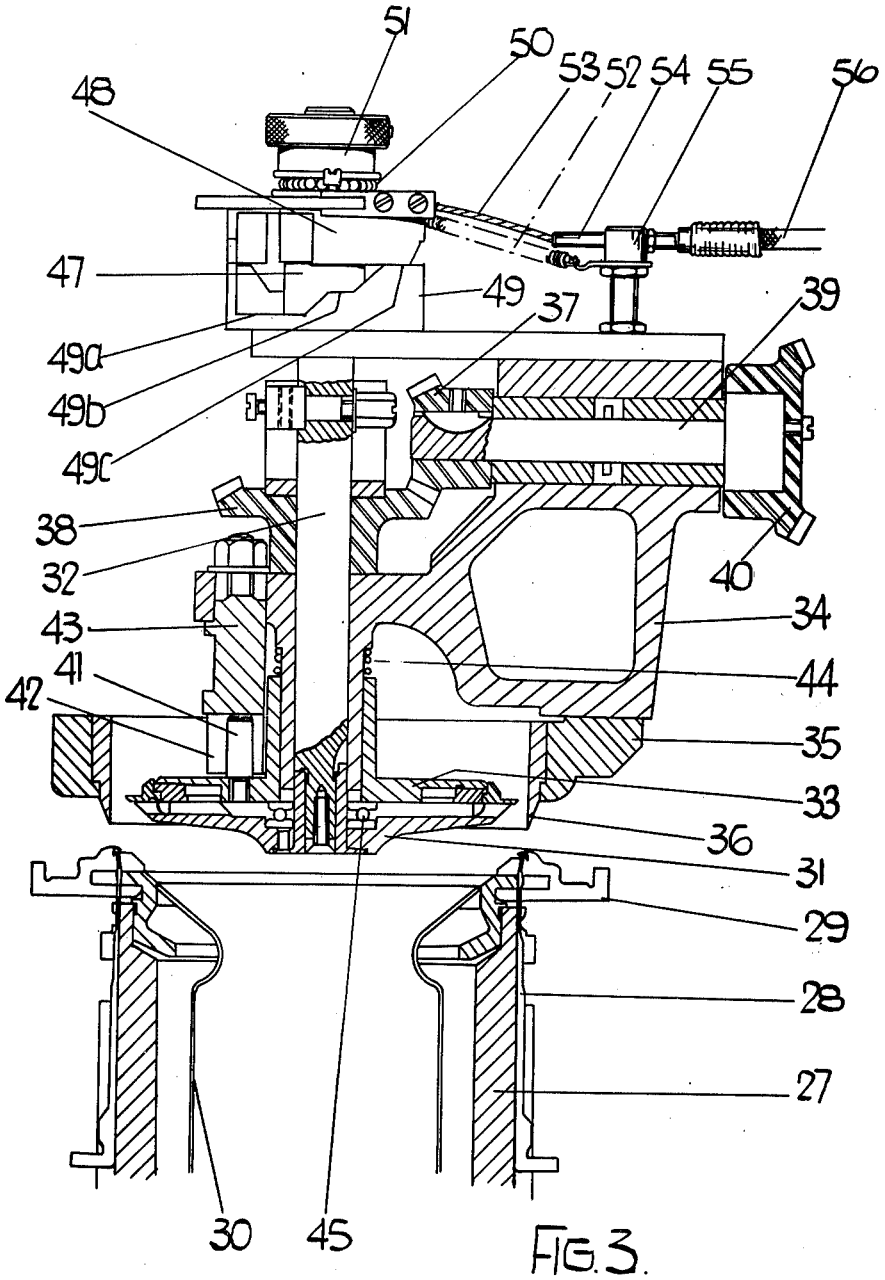
Figure 6:
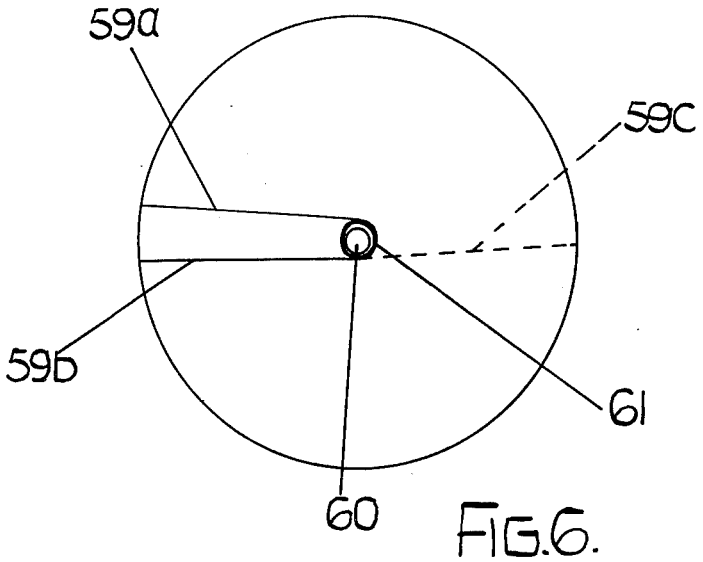
Figure 10:
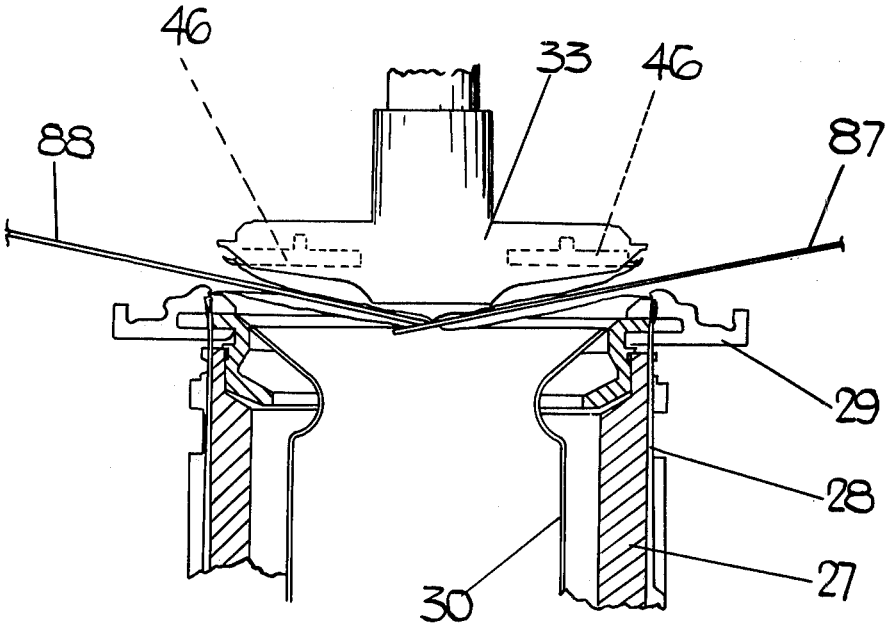
Figure 7:
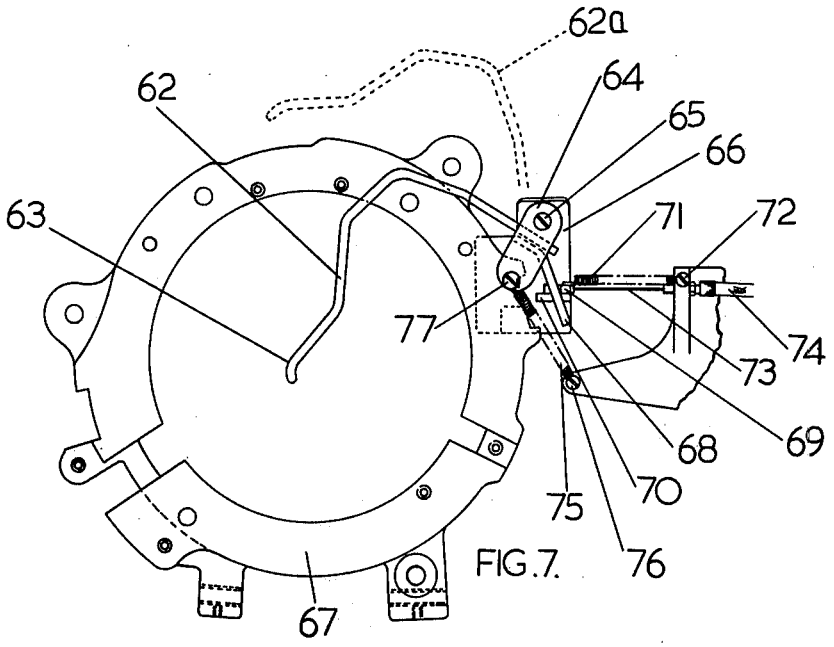
Figure 8:
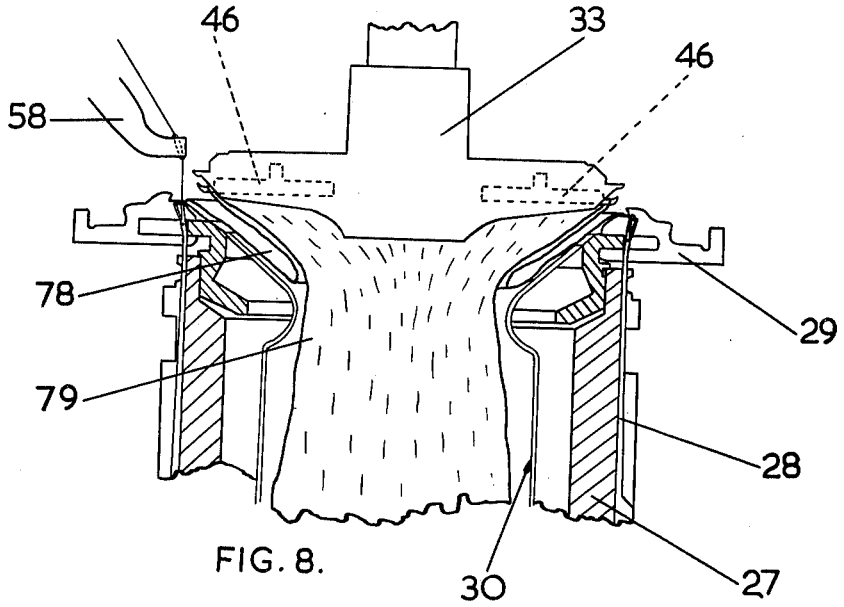
Figure 9:
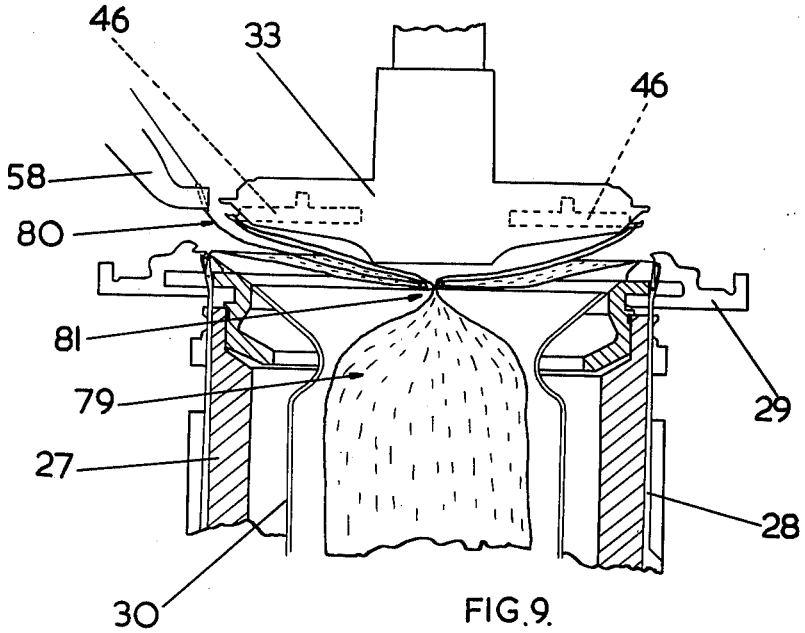

In the drawings;

FIG. 1 is a view of a ladies stocking incorporating the invention and shown in a laid-out and partly folded condition, FIG. 2 is a somewhat diagrammatic cross-sectional view of the toe end of the stocking, FIG. 3 is a view in cross sectional elevation of relevant parts of a circular knitting machine of the cylinder and dial type, FIG. 4 is an elevation view partly in cross section of certain of the parts shown in FIG. 3 illustrating the formation of fabric, FIG. 5 is a view corresponding to FIG. 4 illustrating the procedure in closing the fabric, FIG. 6 is a plan view showing the fabric being closed, FIG. 7 is a plan view of parts of the machine showing a presser means to act on the fabric, FIGS. 8 and 9 are views corresponding to FIGS. 4 and 5 but illustrating an alternative procedure, FIG. 10 is an elevation view partly in cross section showing the provision of opposed plates for drawing together fabric to a closed form, FIG. 11 is a plan view on a reduced scale of the fabric engaging ends of the plates of FIG. 10, and FIG. 12 is a diagrammatic view of parts of a double cylinder circular knitting machine illustrating an alternative to the procedure of FIGS. 4 and 8.

Referring firstly to FIGS. 1 and 2 there is shown a ladies stocking having a turned welt 13, a leg or panel 14, a foot 15 and a toe end part 16. The part 16 is formed of 2 ply fabric having been formed in the manner of a turned welt which has been closed on the knitting machine by constriction of the welt like portion at the crease thereof to bring it to a substantially closed condition leaving only a very small opening 17 to which the crease line of the welt like portion has beem constricted. Wale lines 18 and gather lines 19 extend radially from the small hole 17. Conveniently the 2 ply toe end portion 16 is formed of thinner fabric in the part between a circular course line 20 and the small opening 17.

The stocking shown has been knitted in the direction starting from the toe end and proceeding along the foot 15 and panel 14 to the turned welt 13. When knitted in this direction it is necessary on completion of the welt 13 to knit a few courses of anti-ravel fabric forming a non-run terminal band which is on the inside of the bottom of the welt at the position indicated at 21. The stocking may however be knitted in the opposite direction commencing with the welt 13 this being the more orthodox direction of knitting a stocking. In this case as will be explained later the article will be completed with an anti-ravel band on the inside of the back of the toe portion at the place indicated at 22 and the small hole 17 may need to be somewhat larger in size.

FIG. 2 shows the structure of the closed welt like toe end portion 16, the outer and inner plies being indicated at 16*a* and 16*b* and there being a binding yarn or thread 23 serving to constrict the welt like part 16 at its crease line and having ends 24 and 25 extending between the plies 16*a* and 16*b* up to the line 26 at which the plies are joined. The ends 24 and 25 of the binding yarn or thread are knitted into the tubular fabric at the neighbourhood of the join line 27. As already indicated the toe end part 16 may be closed in other ways than with a binding yarn or thread such as 23, for example by heat setting or welding to closed form whilst on the knitting machine or by a melted insert ring or coil at the position of the binding turns 23. Also a toe end portion such as 16 closed in any of the manners referred to may be formed on other clothing articles having foot portions e.g., stocking tights, socks or other similar garments.

The stocking shown in FIGS. 1 and 2 may be knitted on a circular knitting machine of the cylinder and dial type relevant part of which are illustrated in FIG. 3. In this Figure there is shown a machine of generally orthodox kind which has been modified somewhat for the performance of the invention. The machine comprises a needle cylinder 27 having needles 28 and sinkers 29 and a central throat tube 30 through which the fabric is drawn downwardly by suction. Co-operating with the cylinder 27 and above it is a dial 31 fixed to a dial shaft 32 and rotated thereby in relation to a non-rotary dial cap 33. The dial shaft 32 is rotatably mounted in an arm part of which is shown at 34 and on which is mounted a latch guard ring 35 and latch guard 36, both of which are concentric with respect to the dial shaft 32 and cylinder 27. The dial shaft 32 is driven in orthodox manner through bevel gears 37 and 38 from a shaft 39 at right angles to it and carrying a further bevel gear 37 through which the drive is transmitted. The dial cap 33 carries an upstanding pin 41 engaging in a slot 42 in a fixed part 43 to restrain the dial cap against rotation but permitting it to have up and down movement, and it is urged downwardly by spring 44 towards the dial 31, an anti-friction bearing 45 being interposed between the cap 33 and dial 31. The dial 31 carries welt hooks 46 as seen in FIGS. 4 and 5 which have butts acted on by bolt cams (not shown) carried by the dial cap 33 and serving to project and withdraw the welt hooks as and when required.

To raise and lower the dial shaft 32 and with it the dial 31 there is a bush 47 in which the upper end of the dial shaft 32 rotates, such bush being provided with a camming arm 48 to co-operate with a stationary cam 49. The upper part of bush 47 bears upwardly through an anti-friction bearing 50 against a collar 51 secured to the top end of dial shaft 32. The collar 51 screws on to the top end of the shaft for adjustment purposes. It will be seen that the cam 49 has three horizontal levels, namely a bottom level 49*a*, intermediate level 49*b* and top level 49*c*, these being joined by cam slopes on which the camming arm 48 can ride. There is a tension spring 52 acting on the camming arm 48 to bias it to swing towards the left of FIG. 3 so as to ride down on to the bottom level 49*a*, the spring 44 serving to move the dial shaft 32 downwardly when the camming arm 48 moves in this way. Also attached to the camming arm 48 is a Bowden cable 53 acting through a tube 54 on an anchorage 55 and having a sheath 56, by means of which cable the camming arm can be moved to the right and caused to ride up cams 49 to the top-most position shown in FIG. 3. The cable 53 is operated from a control drum or other suitable control means. The lowermost and intermediate levels 49*a* and 49*b* on the cam 49 are as usually provided for movement of the dial 31 between lowered and raised positions as in normal welt production. The addition of high level 49*c* is provided so that the dial 31 can be raised to an extra high level as is found advantageous in practising the invention.

A machine having the parts shown in FIG. 3 is capable of retaining loops of initial courses of fabric on the hooks 46 while knitting is continued by needles 28 of the cylinder 27 so as to produce a knitted tube extending in a depending fold 57 (FIG. 4) from the hooks 46 to the needles 28. Such procedure is well known for producing the folded fabric which comprises a turned welt. It is, however quite simple to modify this procedure to produce closure means for the fabric tube.

Having reached the stage where a short folded length 57 of fabric about equal in length to the radius of the needle circle of the cylinder 27 is extending from the dial hooks 46 to the needles 28, a yarn feeder 58 is moved from a feeding position shown in FIG. 4 to a raised position as in FIG. 5 where it will cause yarn that has previously been knitted to be supplied over the tops of the needles 28 to the fabric without actually knitting the yarn, that is to say the yarn is fed into a peripheral space between the dial 31 and the tops of needles 28. It is advisable for the cylinder 10 and dial 11 to be slightly separated to provide such space. For this purpose the camming arm 48 is at this time moved by the cable 56 up from cam level 49*b* on to cam level 49*c* thereby raising the dial 31 above its normal working position. The feeder 58 may be additional to a feeder which supplies yarn from which the short length of fabric 57 has been knit in which case it will be caused to feed its yarn as in FIG. 4 to only a small number of needles before being moved to what may be termed a laying in position as in FIG. 5. Its yarn will thus extend from the last needle 28 which has knitted it (and to which it is attached) and be drawn around the outside of the fabric tube. The thus drawn yarn length is indicated at 59.

It is advantageous at this stage of the procedure to press the fabric inwardly towards a closed condition in readiness for it to be constricted, for example, by binding yarn round it as just described, at the part which in a welt would form the crease of the welt. For this purpose a presser arm 62 FIG. 7 is provided. This is formed by a shaped rod or stout wire having a curved fabric-engaging end 63 and its opposite end fixed to a lever 64 pivoted at 65 to a supporting bracket 66 attached to a cam plate below the sinker cap 67. Also attached to the lever 64 is an actuation bar 68 engaged by the upper end of an upstanding lever 69 pivoted amidships to an upstanding lug 70 on the bracket 66. Lever 69 has its upper end acted on by a tension spring 71 coupled to a fixed anchorage 72 so that the spring urges the top end of lever 69 to the right as seen in FIG. 7. The lower part of lever 69 below its pivot is coupled by a Bowden cable 73 (having a sheath 74) to a control member for example by the main control drum or other means on the machine. Thus a pull on the cable 73 will rock the lever 69 against the action of spring 71 so as to swing the presser 62 clockwise about its pivot 65 away from the knitting zone to the dotted line position shown at 62*a* in FIG. 7. The lever 64 carrying the presser arm 62 is also biased by a spring 75 extending from a fixed anchorage 76 and anchored to the lever 64 at 77 to urge the pressure arm 62 to the operative position shown in full lines in FIG. 7.

The presser arm 62 is normally held out of action in the dotted line position except when the welt like fabric 57 is about to be closed. At this time the control means acting through the cable 73 releases the presser arm so that it is swung inwardly under the action of the springs 71 and 75 towards a limiting stop provided on the upstanding lug 70, this stop determining the most inward position required to be occupied by the presser arm 62. When the presser arm 62 moves inwardly it engages the welt like fabric 57 as the latter is rotating with the cylinder 27 and dial 31, so that the fabric is thereby progressively tucked into a constriction in readiness for a coil of yarn or other closing means to be passed round the constriction in the fabric to cause it to be retained in closed condition.

While the yarn length 59 is being supplied, knitting is stopped with yarn supplied by the main feeder, the needles are lowered and the main yarn is cut and trapped. Therefore the effect is that the laid in yarn will simply be lapped around the short fabric tube extending from the dial hooks 46 to the needles 28. The welt fabric 14 will thus be drawn to the form shown in FIGS. 5 and 6. If sufficient tension is put on the lapping yarn 59 it will draw the fabric tube into a closed neck at 60 by constricting that part of the fabric which is about equidistant from the dial hooks 46 and the needles 28. With each successive revolution of the cylinder and dial, successive turns of yarn will be obtained around the neck of the fabric as indicated at 61 in FIG. 6. When a desired number of turns has been made, the feeder 58 is then moved from the laying-in position to the knitting position so that its yarn is again taken by the needles 28 which are raised to receive it, the main yarn being also reintroduced. Thus the lapping yarn is locked into the fabric. The lapping portion of yarn 59 may extend inwards at 59*a* to the neck 17 of fabric and then back outwardly at 59*b* alongside the stretch 59*a*. Alternatively the outward return stretch may be caused to extend at some other position angularly offset from the stretch 59*a* for example diametrically opposite as shown in chain line at 59*a*. To complete the closure, the loops held on the dial hooks 46 are transferred to the needles in the normal manner as when closing a welt.

Although the yarn feeder 58 has been described as being an auxiliary feeder in which case the knitting action is temporarily suspended (without severing the yarn) whilst the feeder is operating as indicated in FIG. 5 to supply the yarn to encircle the constriction 60, knitting action being recommenced as soon as the feeder 58 has been returned to feed the yarn into the needle hooks. As first described the feeder 58 may be arranged to supply a separate yarn which is only knitted into the fabric for a sufficient distance to lock its ends before and after it is laid between the plies of the folded fabric 57 and caused to encircle the constriction 60, or such separate yarn may be knitted throughout along with the main yarn except when it is caused to encircle the fabric tube. Additional tension may be applied in any convenient manner to the yarn supplied by feeder 58 when it is being laid between the plies of the folded fabric 57 and caused to encircle the constriction 60.

The toe portion produced by this method constitutes a double layer fabric having a coursewise extending fold containing a tight winding of yarn which draws the fabric tube together to constrict it to a closure at the end containing the fold. It is desirable to reduce the bulk of the double layer fabric in the toe portion as much as possible particularly in the region of the constriction of the fabric. This may be done at least partly by knitting the toe portion on less than the whole number of the needles 28, for example, half the number of needles in the cylinder 27. In this case the fabric is commenced on only those needles 28 (for example alternate ones of them) that are to be used to form the fabric of the toe end 16 whilst the remaining needles are kept in a low inactive position, such remaining needles being brought into action only after the fabric of the double ply toe end portion 16 has been completed. Further the fabric which is to be in the region of the constriction 60 (for example that in the area between the line 20, FIG. 1 and the closure point 17, in each ply) may be knitted of finer yarn than the remainder of the fabric has to reduce its bulk still further and facilitate its constriction to closed form. This may be carried out by causing a yarn change to occur in known manner at positions shortly before and shortly after the course line which is to lie at the constriction 60 so as to change over to and back from performing knitting with a fine yarn. Alternatively or in addition such reduced bulk at the region of the constriction 60 may be produced by modification of the fabric structure in the band of fabric referred to, for example by incorporation of missed stitches in the fabric structure.

A toe portion as already described may be incorporated in a sock, stocking or similar footwear article at either the commencement of knitting of the article as explained above or at the final stage thereof. If incorporated at the commencement, the make up may follow closely the procedure used for the conventional turned welt, but after returning the held dial loops to the needles the foot portion and then the leg would be knitted and finally the welt which, whether turned or otherwise, would be required to be locked to prevent unroving. Such locking is conveniently performed by knitting a small number of courses of anti-ravel fabric to follow the welt immediately before the stocking or other article is pressed off the machine. The formation of the welt at the final stage would be carried out with the welt dial 31 at intermediate level after lowering out of action those needles which are in line with the welt hooks 46, projecting the welt hooks and knitting a course with portions of the yarn laid over the welt hooks, then withdrawing the welt hooks, and bringing all needles into knitting action to knit the fabric constituting the welt. On completion of the latter the loops held by the welt hooks are returned to the appropriate needles, after which the anti-ravel fabric is knitted. The courses of anti-ravel fabric will form a narrow curled-up band on the inside of the welt.

If the stocking, sock or the like is commenced at the welt end (i.e., the end opposite to the foot) in the usual way, after completion of the welt and then the leg and foot portions, missed stitches (which may be regarded as becoming sinker loops) of the last course of the foot (corresponding in position to the last circular course knitted before a reciprocatory knitted toe pouch) are retained on the dial hooks 46 while knitting the short length of welt like tubular fabric which is to contain the lapping yarn (correspondng to 59) for closing the toe as previously described. The engagement of the hooks 46 with the missed stitches occurs in the same way as at the commencement of a welt knitted last as just described. With the toe end knitted last, however, after transferring the dial loops back to the needles 28, a few courses of anti-ravel fabric of known construction, or other locking means, must be provided before pressing off the stocking, sock or the like, and this as will appear later will be formed on the inside of the fabric.

The procedure for forming the closed toe at the termination of knitting instead of as the first part of the knitted fabric tube may be performed in two main ways, namely (a) by knitting both the stocking leg and foot and the toe fabric using the full complement of needles, and (b) knitting the stocking leg and foot on the full complement of needles and the toe fabric on a reduced number of needles. Dealing first with method (a) the procedure is as follows, reference being made to FIGS. 8 and 9 of the drawing. Having knit the welt, leg and foot portions and reached the stage where it is required to commence the toe, the stocking is held on the full complement of the needles 28. Certain spaced needles are now caused to remain in a low non-knitting track where they hold their loops. Dial hooks 46 above these low needles are projected with the dial 31 at intermediate height so that yarn can be laid over them and into the hooks of the remaining active needles 28 and then the dial hooks are withdrawn to hold the fabric while all the needles are employed to knit the toe fabric, the previously lowered spaced needles being raised for this purpose. Knitting continues until a welt-like fold of toe fabric 78 is generated between the needles and the dial hooks and this fabric hangs like a skirt around the foot portion of the stocking indicated at 79, which, (due to the laying of the yarn over the dial hooks) is now hanging from the dial 31 as shown in FIG. 8. When a sufficient length of toe fabric 78 has been knitted, the coiling yarn 80, FIG. 9, is introduced by feeder 58 to constrict the toe fabric at its fold as indicated at 81. This constriction takes place with the foot fabric 79 also constricted within the toe fabric 78 and therefore the constricting coils must be loose enough to allow the foot fabric to be subsequently withdrawn.

After the coiling yarn 80 has been anchored to the fabric, the held loops on the dial hooks 46 are transferred to the needles to close the fold of the toe fabric, and a few courses of anti-ravel knitting are made after which the finished stocking is released from the needles. The foot and toe fabric are then withdrawn through the constriction 81 leaving the constriction at the toe extremity and the anti-ravel band on the inside.

In the second method of producing the stocking, welt first, the welt, leg and foot are made as before up to the stage at which the toe fabric is to be commenced. At this point a few courses of anti-run fabric are knitted and then alternate ones of the needles 28 are made to shed their loops and are maintained at a low inactive level. The dial hooks 46 are then projected above these low needles and yarn is laid over the dial hooks 46 and into the hooks of the remaining active needles 28. The dial hooks 46 are then withdrawn to hold the fabric while these active needles only are employed to knit the toe fabric 78, the aforementioned alternate needles remaining inactive. Knitting continues, to produced a welt-like fold of toe fabric 78, which, as described in connection with method (a) and shown in FIG. 9 is constrained by a coiling yarn 80 with the foot fabric 79 also constricted within the toe fabric at 81, and therefore the constricting coils of yarn 80 must be loose enough to allow the foot fabric to be subsequently withdrawn.

After a sufficient number of turns of the constricting yarn 80 have been formed the previously lowered needles are brought back into knitting activity and the coiling yarn is anchored to the fabric by being knitted into it, using all needles for the final portion of the toe fabric. Afterwards the held loops on the dial hooks 46 are transferred to the needles 28 to join the fabric together in a double layer and thus complete the toe. A few courses of anti-ravel knitted structure are then made using all the needles, the finished stocking is released from the needles, and the toe end part reversed through the closure restriction 81.

With the toe end part of the fabric tube (for a garment having a foot portion) knitted last as described in relation to FIGS. 8 and 9, the need for having the foot part 79 constricted within the toe fabric 78 (and therefore for slackening the constriction at 81) can be avoided by withdrawal of the tubular fabric upwardly. For this purpose the dial 31 and its shaft 32, or other equivalent parts on machines of other forms suitable for forming the improved fabric closure, will be so constructed as to present a central upwardly extending tube connected to a suction source to produce an appropriate upward air current through the tube thus presented. As the tubular fabric knitted prior to the toe fabric is produced it will be withdrawn centrally upwardly and so the foot fabric 79 will not be within the folded toe fabric 78 when the latter is closed by the binding yarn 80 enabling the latter to be bound tightly to form a substantially complete closure. On withdrawal upwardly the fabric tube will be inside out and will need to be reversed. The reversal will cause the final anti-ravel band to be brought, as is desirable, to the inside of the fabric.

Procedures which are the same as, or closely similar to those above described may be practised with a circular knitting machine of the cylinder and dial type in which the dial forms a second needle bed, and also with a circular knitting machine of the opposed needle cylinder type equipped with double ended needles capable of being transferred from cylinder to cylinder as required. In each case needles in the dial or upper cylinder as the case may be would perform substantially the same functions as the dial welt hooks 46 aforementioned, the needles in the opposed needle cylinder type of machine being arranged so that needles in the upper cylinder alternate in 1 × 1 sequence with those of the lower cylinder. FIG. 12 shows how a welt type of folded fabric 82 (similar to the folded fabrics 57 and 78) is formed with an opposed needle cylinder machine the upper and lower cylinders being indicated at 83 and 84. The initial courses of the welt type fabric 82 are held on needles 85 in the upper cylinder whilst the fabric is being formed on needles 86 in the lower cylinder. At an appropriate stage the closing procedure of FIGS. 4, 5 and 6 is performed and thereafter the needles 85 are transferred to the bottom cylinder 84 and all needles caused to knit, anti-ravel fabric being formed on the bottom cylinder needles 86 when required.

An alternative procedure shown in FIGS. 10 and 11 consists in forming the welt like fabric 57, 78 or 82 as before and at an appropriate time bringing inwards against such fabric between its plies two presser plates 87 and 88 diametrically opposed with suitably shaped ends 89 and 90 to draw in the tubular fabric and (if necessary by overlapping) constrict it to the extent of closing it as at 91. The plates 87 and 88 are conveniently mounted and guided so as to slide in and out on a downwardly and inwardly sloping angle as show and are arranged to press together around the fabric to constrict it into the confined closure form as at 91 due to the shaping of the edges 89 and 90 which engage the fabric tube as it is rotating. The plates 87 and 88 may press together around the constricted fabric complementary portions of thermoplastic or thermosetting strip or filament coils to form a circular clip and heat and/or chemically acting medium may be applied through the plates 87 and 88 to set and/or weld the fabric or the circular clip in closed condition. Alternatively the plates 87, 88 may apply heat to a low melting point yarn in the fabric so as to fix the closure.

The machine elements by which the welt like fabric providing an end closure to the fabric tube is formed are controlled by machine control means which is largely of orthodox type. The movement into and out of action of the feeder 58 by which a constricting yarn is supplied, the projection and withdrawal of the welt dial hooks 46, the operation of the presser arm 62, and the actuation of any other machine part movements are effected by instrumentalities actuated in correctly timed sequence from a main control drum or other equivalent part which is caused to move in steps conveniently by impulses derived from patterning means (e.g. a in with projections) which is itself moved step by step at regular or other appropriate intervals related to the working of the machine.

As already indicated the yarn supplied for closing the tube may be an extra yarn, additional to yarn or yarns employed for the main knitting operation. In this case the additional feeder required for such a yarn may be controlled by its own mechanism separately from the other feeder or feeders, and the yarn may have an additional tensioning device for tensioning it to draw the fabric together.

The looped yarn in the procedures illustrated may if desired be of a thermoplastic material having a low melting point so chosen as to be fusable to fix the closure of the tubular fabric when heat setting treatment is applied to set the remainder of the fabric.

It should be understood that in practising the invention by constricting the fabric tube by lapping a binding element around it there may be employed either a single yarn or a plurality of yarns as the encircling means to constrict the fabric. Moreover the invention may conveniently be practised on a circular knitting machine having a plurality of multiplicity of feeding stations spaced apart around the needle cylinder. In this case the binding yarn or yarns may be supplied at a particular one or ones of the feeding stations, knitting being performed at the remaining station or stations at which the supply of the binding yarn or yarns occurs. For example in a four feed machine a binding yarn may be supplied only one feeding station or at each of two feeding stations (for example two diametrically opposite stations), the knitting of the tubular fabric being carried out all four stations or if desired only at the stations other than those at which the binding yarn is supplied. Similar procedures may be followed in machines having more than four feeding stations

What we claim is:

1. A method of knitting an end portion of a tubular knit fabric article using a circular knitting machine, said method comprising knitting an initial portion, knitting a plurality of courses to form a length of tubular fabric while supporting said initial portion above the level of knitting, looping a yarn under tension around said length of tubular fabric while said initial portion is supported to form a constricting loop that confines the portion of said length of tubular fabric thereat to a substantially reduced tubular size, and knitting a subsequent course of said tubular fabric with said initial portion knit therein to form said length of fabric in a two ply construction with an end at which said constricting loop yarn is disposed between said plies.

2. A method of knitting a tubular seamless hosiery article on a circular knitting machine, which comprises knitting a tubular foot portion, knitting a first course of a toe portion, knitting further courses of said toe portion as tubular fabric depending from loop holding instruments of said machine engaging loops of said first course, looping a binding yarn under tension around the depending toe fabric to constrict.

3. A method according to claim 2, comprising the step of urging the depending fabric inwardly by moving a presser device against it during the looping of said binding yarn around it.

4. A method according to claim 2, comprising the steps of knitting the binding yarn into the fabric to anchor it thereto before and after looping it around the depending fabric.

5. A method according to claim 2, wherein the binding yarn is looped around the depending fabric for a plurality of turns.

6. A method according to claim 2, wherein the binding yarn is a yarn used in the knitting of the fabric article.

7. A method according to claim 2 wherein the article is knitted in the direction of toe first.

8. A method according to claim 2, wherein the article is knitted in the direction of toe last and after knitting together the first and last formed courses of the toe portion a band of anti-ravel fabric is knitted before pressing the article of from the needles of said machines.

9. A method of knitting a tubular seamless sock on a double cylinder circular knitting machine, which comprises knitting tubular leg and foot portions, at least one of said leg and foot portions being knit on needles knitting in both cylinders of said machine, knitting a first course of a toe portion, knitting further courses of said toe portion as tubular fabric depending from needles in one of the cylinders of said machine, looping a binding yarn under tension around the depending toe fabric to constrict it to at least a substantially closed form and knitting together said first course and a last formed course of the toe portion to anchor them to a course of said foot portion.

10. A method according to claim 8, wherein the needles used to hold the first course during knitting of the remainder of the toe portion are needles in the upper cylinder and wherein the sock is drawn upwardly, at least during the knitting of the toe portion, by air flow through the upper cylinder.

11. A double cylinder circular knitting machine for knitting a tubular seamless sock, said machine comprising upper and lower cylinders, means for knittng a turned welt and means for introducing, immediately prior to completion of the welt, a coiling yarn under tension between the plies of the welt to constrict it to at least a substantially closed form.

12. A circular knitting machine for knitting a tubular seamless fabric article comprising a needle cylinder, a yarn feeder and instrumentalities for knitting fabric in the manner of a turned welt to form a double thickness end portion of the article, and including control means for said feeder and said instrumentalities arranged to operate immediately before completion and doubling of such end portion fabric first to cause said feeder to feed binding yarn to needles so as to be knitted thereon, then to cause such yarn to miss the needles and to be bound around the end portion of the fabric under tension to constrict it to substantially closed form, and afterwards to cause said feeder to feed said yarn back onto the needles so as to be knitted thereon.

13. A machine according to claim 11, comprising a presser device movable inwardly against the fabric and means for moving the presser device to urge the fabric inwardly in readiness for the binding of the yarn around the fabric to constrict it.

14. A machine according to claim 11, wherein the instrumentalities for knitting fabric in the manner of a turned welt comprise a circular series of loop holding instruments on a mounting presenting a central upwardly extending tube, and a suction source connected to said tube for upward draw-off of the fabric knitted on needles below said instruments.

* * * * *